United States Patent [19]

Frank

[11] 4,435,795

[45] Mar. 6, 1984

[54] CELESTIAL CLOCK

[75] Inventor: John Frank, Anchorage, Ak.

[73] Assignee: A.I.M. Services, Anchorage, Ak.

[21] Appl. No.: 251,880

[22] Filed: Apr. 7, 1981

[51] Int. Cl.[3] ..... G04B 19/26

[52] U.S. Cl. ..... 368/16

[58] Field of Search ..... 368/15–20, 368/28, 35, 37, 77, 223, 228, 233

[56] References Cited

U.S. PATENT DOCUMENTS

| | | | |
|---|---|---|---|
| 79,026 | 6/1866 | Terry | 368/37 |
| 245,130 | 8/1881 | Burman | 368/18 |
| 246,061 | 8/1881 | Blair | 368/16 |
| 402,005 | 4/1889 | Deichmann | 368/16 |
| 508,467 | 11/1893 | Clark | 368/18 |
| 521,725 | 6/1894 | Molesworth | 368/15 |
| 583,540 | 6/1897 | McDonald | 368/16 |
| 754,845 | 3/1904 | Burke | 368/16 |
| 1,088,896 | 3/1914 | Guedry | 368/16 |
| 1,126,214 | 1/1915 | Herschede | 368/18 |
| 1,153,492 | 9/1915 | Hoitinga | 368/16 |
| 1,416,605 | 5/1922 | Bulka | 368/16 |
| 1,997,511 | 4/1935 | Canepa | 368/18 |
| 2,657,525 | 11/1953 | Allen | 368/18 |
| 3,073,032 | 1/1963 | Fleming | 368/269 |
| 3,721,083 | 3/1973 | Jauch | 368/18 |
| 3,766,727 | 10/1973 | Didik | 368/15 |
| 4,142,306 | 3/1979 | Whitlock | 368/16 |

FOREIGN PATENT DOCUMENTS

| | | | |
|---|---|---|---|
| 78662 | 6/1949 | Czechoslovakia | 368/16 |
| 422096 | 3/1927 | Fed. Rep. of Germany | 368/15 |
| 2,548808 | 5/1977 | Fed. Rep. of Germany | 368/15 |
| 480518 | 2/1938 | United Kingdom | 368/15 |

OTHER PUBLICATIONS

"Watches", Blaillie, Pub. 1929 Methuen & Co. London, pp. 220,221,223,230.

"Geared to the Stars", Harry C. King, Univ. of Toronto Press, pp. 32–41.

"Connections", James Burke, Little, Brown & Co., 1978, pp. 132–133.

*Primary Examiner*—Vit W. Miska

*Attorney, Agent, or Firm*—Schuyler, Banner, Birch, McKie & Beckett

[57] ABSTRACT

A clock for automatically indicating the time of day, the data of the year, the approximate time of sunrise and sunset, the approximate hours of darkness and daylight, the positions of the sun, Mercury, Venus, the earth's moon and phases of the moon, the sign of the Zodiac and degrees of arc of the sign of the Zodiac which the earth is in, all relative to the earth in a geocentric model. The clock includes a center hub representative of the earth, about which an hour disk rotates one revolution clockwise per day, a superposed data disk, an hour pointer and data pointer for indicating the hour and calendar data. The clock further includes a cam lever that oscillates about a pivot point in response to movement about a stationary cam at one end for automatically rotating Venus and Mercury indicators about a sun indicator, and automatically rotating a moon indicator about the center hub. Sun, Mercury, Venus indicators also rotate about the center hub. The clock further includes outer planet indicators which are manually movable.

27 Claims, 7 Drawing Figures

CELESTIAL CLOCK

BACKGROUND OF THE INVENTION

1. Field of the Invention

The present invention relates to a clock for automatically displaying the time of day, the date of the year, the position of the earth in the Zodiac, the approximate hours of daytime and nighttime, approximate times of sunrise and sunset, and the position of the sun, at least one planet and the moon and phases of the moon with respect to the earth.

2. Description of the Prior Art

Clocks that display the phases of the earth's moon are well known to those skilled in the art. Such clocks are described in, for example, U.S. Pat. Nos. 245,130; 508,467; 1,126,214; 1,997,511 and 3,721,083. Such clocks employ a stationary mask that shields appropriate portions of a pictorial representation of the moon from view so that the representation of the moon is obscured to simulate actual phases of the moon. Such displays typically employ a rotating moon wheel having two illustrations of the moon 180° apart on the moon wheel. The moon wheel makes one complete revolution in two lunar months, as exemplified by U.S. Pat. Nos. 508,467; 1,126,214 and 3,721,083. Alternatively, a moon wheel having one illustration of the moon that makes one complete revolution every lunar month may be designed to display the phases of the moon, as exemplified by U.S. Pat. Nos. 245,130 and 1,997,511. Such displays of the phases of the moon, however, do not illustrate the position of the moon relative to the earth.

Devices disclosing celestial data in addition to the time of day are also well known to those skilled in the art. Such devices include, for example, a tellurium employing a sun-centered model displaying movement of the earth and the earth's moon relative to the sun. Such a model is illustrated in U.S. Pat. No. 402,005, which also indicates the sign of the Zodiac in which the earth is located at any given moment, the month, the date, and the season of the year. Such devices, however, do not illustrate the movements of the planets with respect to the earth in a geocentric model.

Geocentric astronomical charts are also well known to those skilled in the art. Typically, such charts include a plurality of small holes for accepting and retaining manually placed pegs carrying bodies representative of bodies of the earth's solar system. Such a geocentric astronomical chart having a conventional clock dial at its center is illustrated in U.S. Pat. No. 521,725. Such devices, however, do not automatically indicate the position of celestial bodies of the earth's solar system with respect to the earth.

A significant need therefore exists for a celestial clock that automatically indicates the position of the sun, one or more planets, the moon and phases of the moon, all with respect to the earth in a geocentric system, and other useful data.

SUMMARY OF THE INVENTION

Accordingly, it is an object of the present invention to provide a clock that conveniently displays more useful data than conventional clocks.

Another object of the present invention is to provide a clock that automatically displays the position and phases of the earth's moon with respect to the earth in a geocentric model.

Another object of the present invention is to provide a clock that automatically displays the positions of the earth's sun and at least two of the planets of earth's solar system with respect to the earth in a geocentric model.

Another object of the present invention is to provide a clock that includes a manually adjustable display of the positions of the outer planets i.e., Mars, Jupiter, Saturn, Uranus, Neptune and Pluto of earth's solar system.

Another object of the present invention is to provide a clock that displays the time of day, date and month, the position of the earth in the Zodiac, approximately the hours of daylight and darkness and the approximate time of sunrise and sunset.

Another object of the present invention is to provide these data in a convenient attractive clock case which may be displayed advantageously in either a horizontal or a vertical plane.

Another object of the present invention is to provide a clock displaying these data which includes a clock pendulum and chimes.

Another object of the present invention is to provide a clock displaying these data which may be conveniently powered by a conventional electrical or mechanical clock motor.

Another object of the present invention is to provide a clock capable of displaying these data that is reasonably simple in construction and that may be manufactured substantially from readily available materials.

These and other objects of the invention are achieved by providing a clock for indicating the daily time and the relative positions of at least two of the celestial bodies of earth's solar system with respect to the earth, comprising: an axis; a center hub representative of the earth centered on the axis; hour indicator means rotatable about the axis one revolution per day; sun indicator means representative of the sun rotatable about the axis one revolution per day; planet indicator means representative of a planet rotatable about the sun indicator means at a rate substantially equal to the planet's natural period of revolution about the sun; and drive means for automatically rotating the indicator means at their prescribed rates.

The clock may also include means rotatable about the axis for indicating the position of the earth's moon with respect to the earth, and the phases of the moon. A date indicator may be included for indicating the date of the year. The date indicator and the hour indicator may comprise separate superposed disks rotatable about the axis. The date disk may also be provided with the signs of the Zodiac.

The invention may be best understood by referring to the following detailed description and accompanying drawings, which illustrate the invention.

DETAILED DESCRIPTION OF THE PREFERRED EMBODIMENTS

Figure 2:
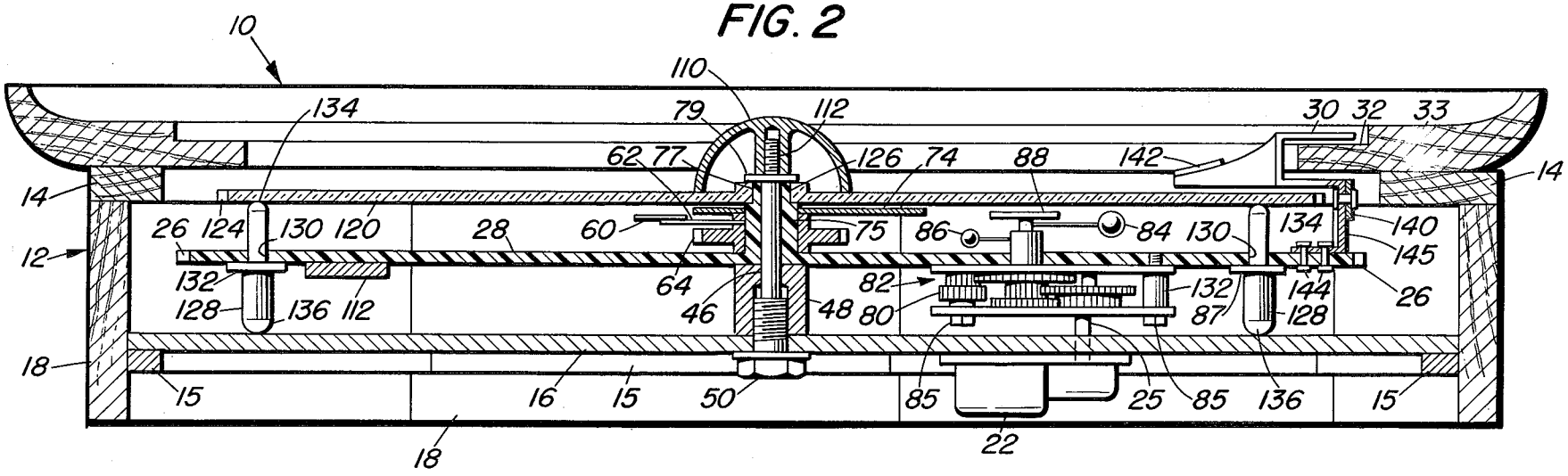
FIG. 2 is a cross-sectional view taken along line 2—2 of FIG. 1, with the cam, cam lever and associated drive components removed for clarity.

Referring to FIG. 2, the celestial clock 10 is housed in a case 12 having a base plate 14, a back 16 and sidewalls 18, which may be constructed of wood or other suitable rigid materials. Back 16 is secured to sidewalls 18 by brace 15.

Figure 1:
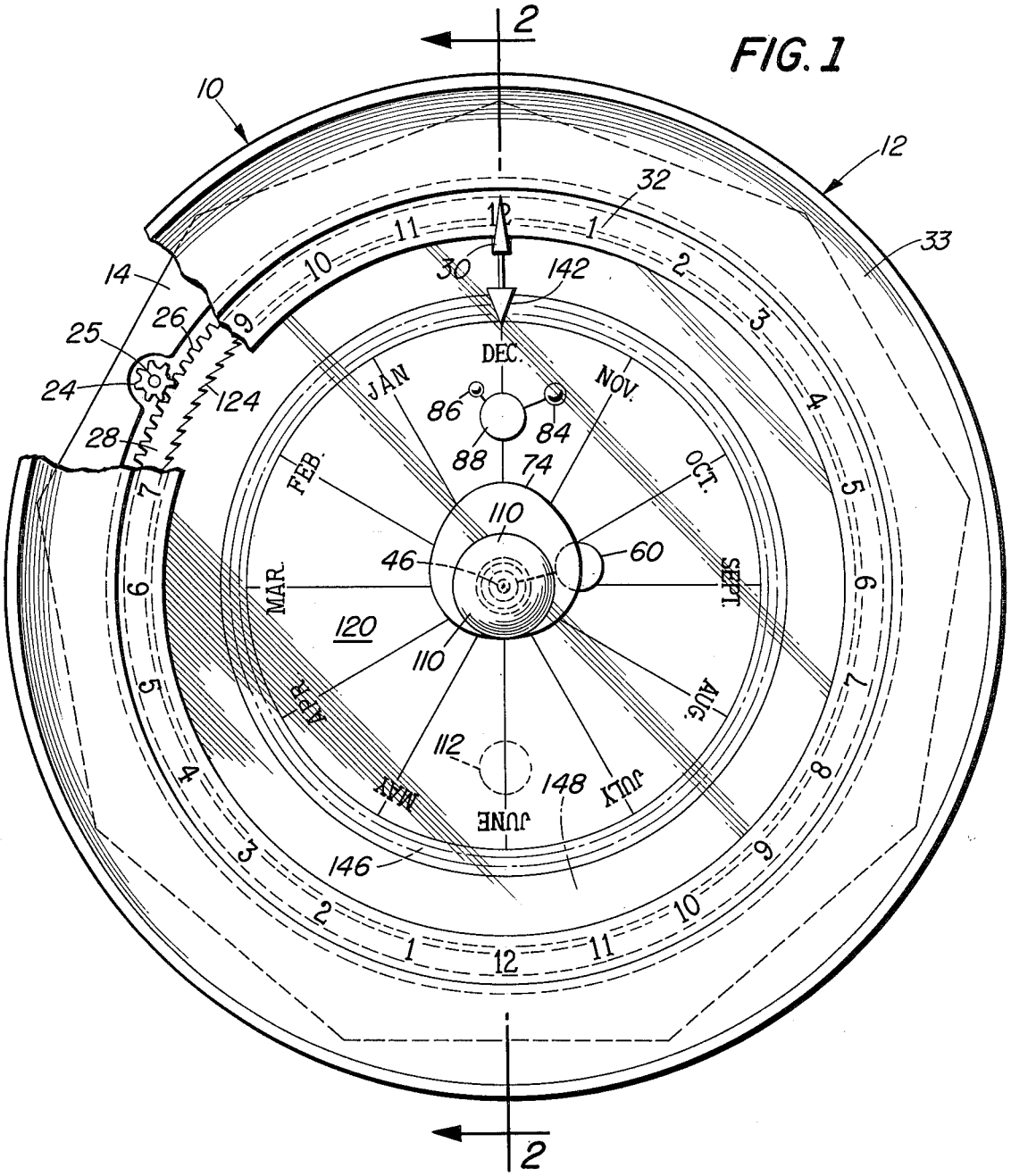
FIG. 1 is a front elevational view of the clock.

The celestial clock 10 is driven by a conventional clock motor 22, which may be electrical or mechanical, including a gear train terminating in drive gear 24 (FIG. 1, 2). Motor 22 and its associated gear train are secured to the underside of base plate 14, while drive gear 24 is secured to the top of a drive shaft 25 which projects upwardly through base plate 14. Drive gear 24 has fifteen teeth and revolves one revolution per hour counterclockwise. Drive gear 24 and all other gears in clock 10 may be constructed of plastic, nylon, brass or other suitable material. In the preferred embodiment all gears are made of nylon.

Drive gear 24 engages teeth 26 along the circumference of an hour indicator disk 28, which has 360 teeth and rotates one revolution per day clockwise about an axis such as stationary shaft 46. Stationary shaft 46 is threadably attached to hollow threaded bolt 50 secured through base plate 14 by a cylindrical nut 48. A stationary earth indicator 110, which may be a hollow hemispherical brass casting, is threadably attached to the upper end 112 of shaft 46. An hour pointer 30 is attached to and rotates with hour indicator disk 28. A continuous stationary 24-hour time scale 32 surrounds hour disk 28 and is borne by a bezel 33 secured to sidewalls 18 of case 12 (FIG. 1). Time scale 32 may alternatively be conveniently numbered from 1 to 12 (a.m.) and 1 to 12 (p.m.). In the preferred embodiment noon is represented by the numeral 12 at top of time scale 32 and midnight is represented by the numeral 12 at the bottom of time scale 32. Thus, as hour indicator disk 28 rotates clockwise, the time in hours and fractions of an hour may be conveniently read from time scale 32 by noting the position of time pointer 30.

Figure 6:
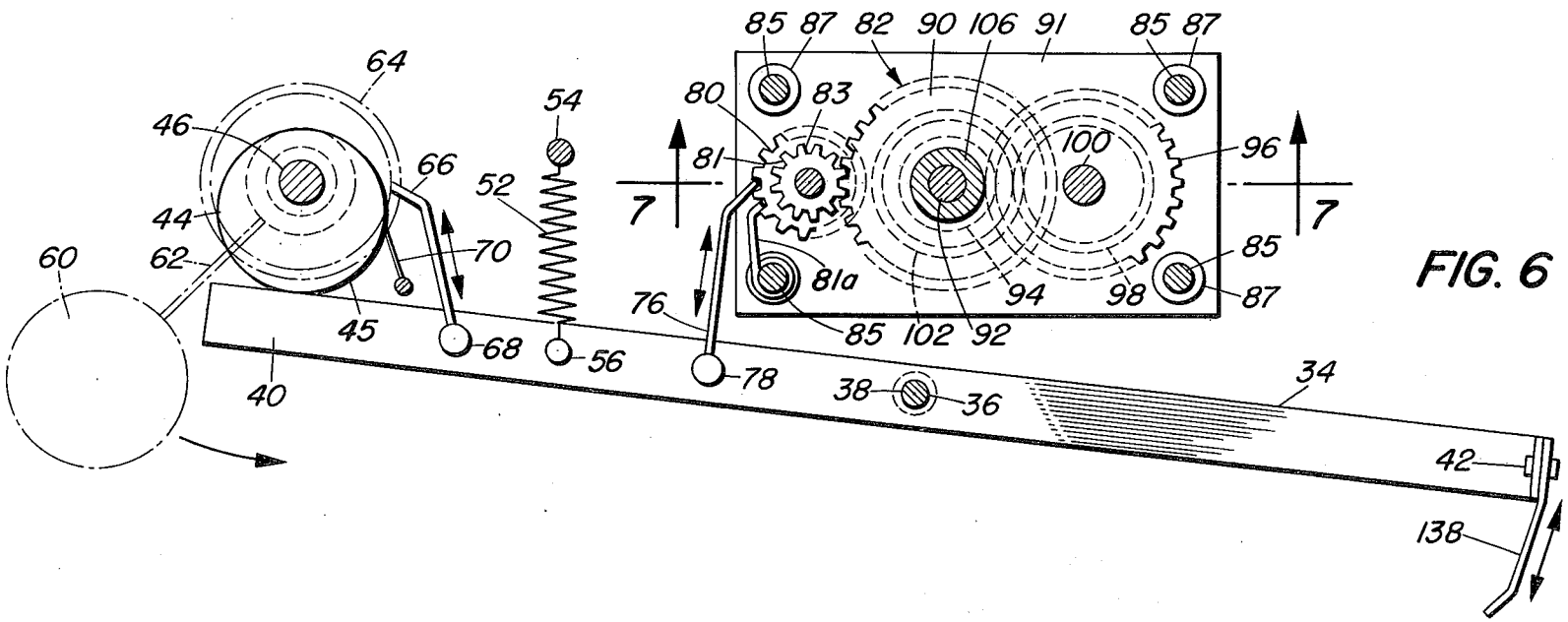
FIG. 6 is a plan view of the driving mechanisms for the moon indicator, and for the Mercury and Venus indicators, with a cover plate of the planet gear train removed.
Figure 4:
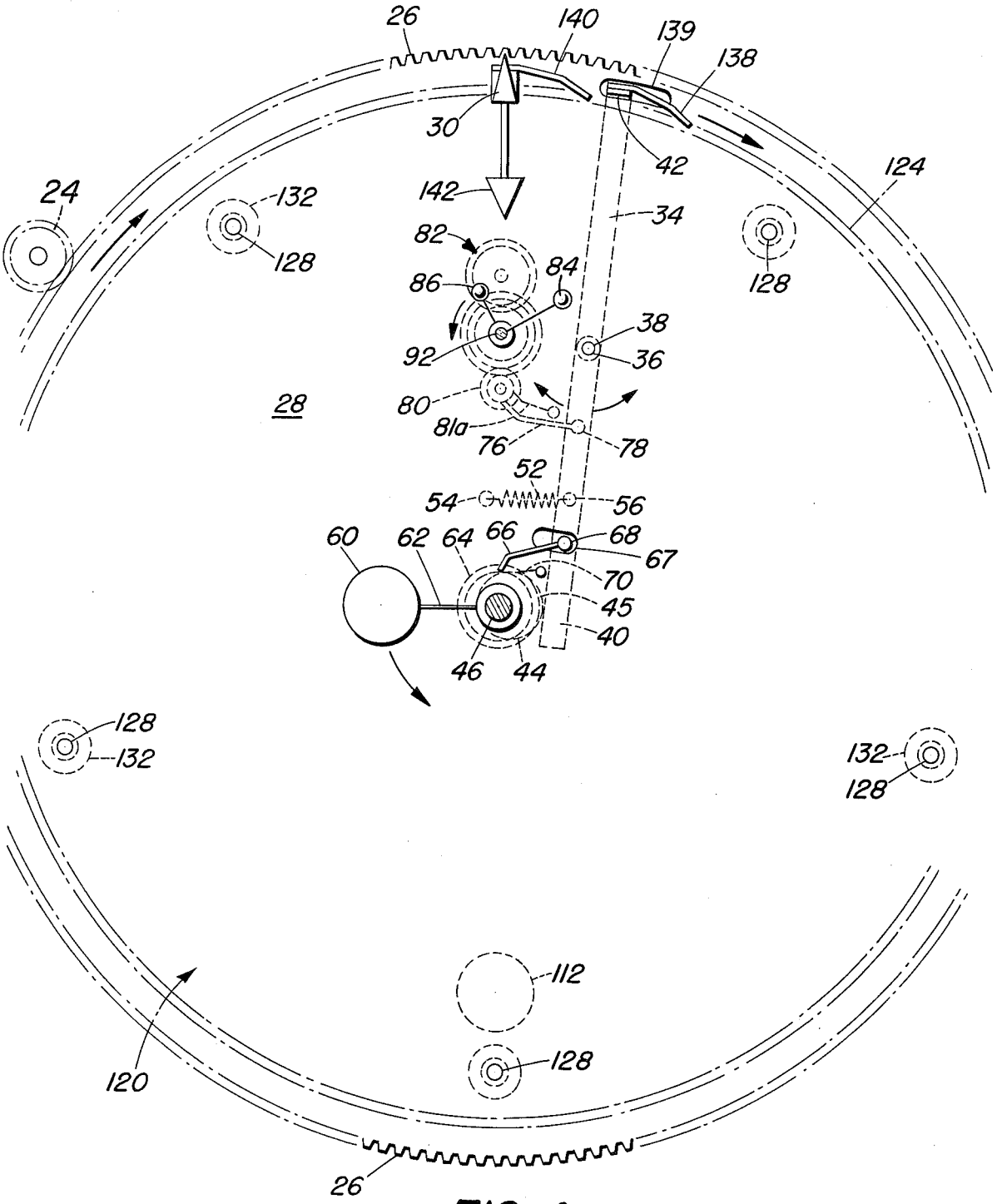
FIG. 4 is a front elevational view of the hour indicator disk and the support studs located on it.

Referring to FIGS. 4 and 6, a cam lever 34 is pivotally attached to hour indicator 28 by suitable attachment means such as rivet 38 at a point remote from cam 44 such as pivot point 36 between the two ends of cam lever 34. Cam lever 34 includes a cam engaging end 40 and date indicator driving end 42. Cam engaging end 40 engages a stationary cam 44 positioned on shaft 46. Cam 44 has a profile 45 which extends about the clock axis. Cam lever 34 is biased against stationary cam 44 by a spring 52 secured to hour indicator 28 by a rivet 54 and secured to cam lever 34 by a rivet 56.

In operation, cam lever 34 provides the motive force for driving all automatic mechanisms of celestial clock 10, except rotation of hour indicator 28. As hour indicator 28 rotates clockwise about shaft 46, cam engaging end 40 of cam lever 34 bears against stationary cam 44 producing oscillating movement of both ends of cam lever 34 with respect to pivot point 36. Each end of cam lever 34 makes one complete oscillating cycle every 24 hours, the period of rotation of hour indicator disk 28. Drive pawls affixed to cam lever 34 convert this oscillating movement to ratcheting rotation of gears that drive most of the automatic clock functions, as described in detail below.

A moon indicator 60 is attached by wire 62 to a moon gear 64 which rotates about an upstanding collar 75 secured to hour indicator disk 28. Moon gear 64 has 30 teeth, roughly equal to the number of days in the lunar cycle. Moon gear 64 is engaged by moon gear drive pawl 66 attached to cam lever 34 by riveted standoff 68 located between pivot point 36 and cam engaging end 40. Riveted standoff 68 extends upwardly through slot 67 in hour indicator disk 28, which is sufficiently wide not to interfere with oscillation of moon gear pawl 66. Moon gear brake 70 attached to hour indicator disk 28 by standoff also engages the teeth of moon gear 64. Moon gear drive pawl 66 and moon gear brake 70 are formed of springy material so that each is in constant ratcheting engagement with the teeth of moon gear 64.

In operation, clockwise rotation of hour indicator disk 28 produces oscillating movement of moon gear drive pawl 66, which incrementally rotates moon gear 64 counterclockwise one tooth per day. Thus, if moon gear 64 has 30 teeth, moon indicator 60 will make one complete revolution every 30 days with respect to hour indicator disk 28. Ratchet brake 70 prevents retrograde rotation of moon indicator 60 while moon gear pawl 66 is in the nondriving portion of its oscillating ratchet cycle, and also causes moon indicator 60 to rotate synchronously with hour indicator disk 28. Moon indicator 60 therefore rotates with basal period of one revolution per day clockwise about earth indicator 110, and a decremental rotation of 1/30 revolution counterclockwise per day, i.e., a net rotation of 29/30 revolution clockwise per day.

Figure 3:
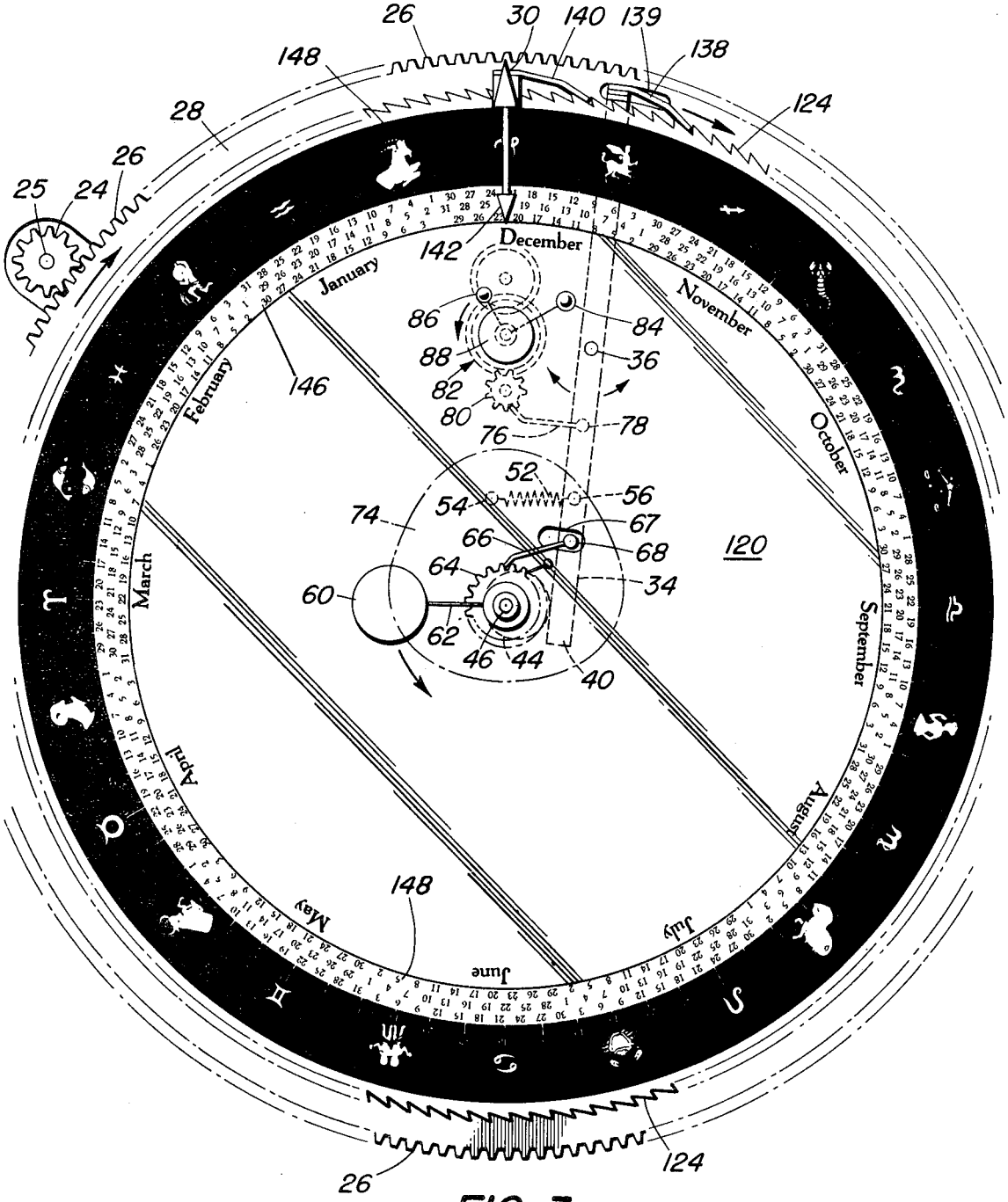
FIG. 3 is a front elevational view of the clock dial and the driving mechanism.

A moon phase indicator 74 (FIGS. 1 and 3) is attached to collar 75 (FIG. 2), for obscuring from view appropriate portions of moon indicator 60 to indicate the phases of the moon relative to the earth by the portion of moon indicator 60 which is visible. Moon phase indicator 74 therefore rotates about shaft 46 with hour indicator disk 28 one revolution per day. Moon phase indicator 74 may be made of plastic, wood or other suitable opaque material. The shape of moon phase indicator 74 is determined by its function and may be accurately determined by those skilled in the art by reference to available moon phase charts or the like.

Referring to FIG. 6, a springy planet gear drive pawl 76, attached to cam lever 34 by a rivet 78, engages planet gear train input gear 80 of planet gear train 82 secured to the underside of hour disk 28, causing planet indicators 84, 86 (FIG. 2) mounted on output shafts of gear train 82 to revolve counterclockwise about a central sun indicator 88 through a series of gear reductions and directional changes.

In the preferred embodiment, planet indicators 84, 86 represent the planets Venus and Mercury, respectively. Choosing Venus and Mercury as the planets to be automatically represented naturally dictates the gear ratios of planet gear train 82, such that Venus indicator 84 makes one complete revolution about sun indicator 88 every 220 days, and Mercury indicator makes one complete revolution every 88 days. It is to be understood that selection of planets other than Venus or Mercury would require different gear ratios and that developing a satisfactory planet gear train for automatic representation of other planets would be obvious to one skilled in the art. In addition, the ratio between gears is more important than the diameter and number of teeth of any specific gear and that gear trains different from that illustrated in the preferred embodiment may be developed to accomplish the same result.

Planet gear drive pawl 76 in the preferred embodiment is in ratcheting engagement with planet gear train input gear 80 and incrementally rotates gear 80 one tooth per day clockwise in response to oscillation of cam lever 34, as discussed above in connection with the moon indicator drive. Planet gear drive pawl 76 is attached to cam lever 34 by a riveted standoff 78 at a point between cam engaging end 40 and cam lever pivot point 36 in the preferred embodiment. Alternatively, planet gear drive pawl 76 may be located between pivot point 36 and date indicator driving end 42 of cam lever 34.

Figure 7:
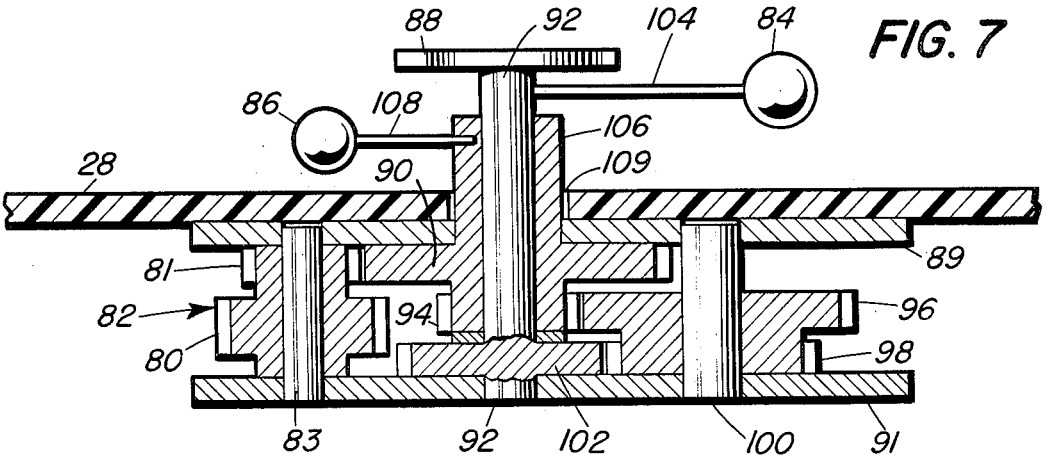
FIG. 7 is a cross-sectional view of the planet gear train for driving the Mercury and Venus indicators taken along line 7—7 of FIG. 6.

Referring to FIG. 7, planet gear train 82 is mounted between top mounting plate 84 and bottom mounting plate 86 and is secured to the underside of hour indicator 28 by screws 85, spacers 87 which keep plates 84 and 86 apart, and nuts 79 (FIG. 6), glue, or other suitable fastening means. Input drive gear 80, rotationally mounted on stationary shaft 83, has 22 teeth and, in operation, rotates one revolution clockwise every 22 days. (All rotational directions are given with respect to a front elevational view.) Input drive gear 80 carries No. 1 drive gear 89, which may be integrally formed with gear 80 to rotate with the same period. Drive gear 89 engages Mercury drive gear 90 with a 4:1 transfer ratio yielding one revolution per 88 days counterclockwise. Mercury drive gear 90 rotates about Venus drive shaft 92 independently of the rotation of Venus drive shaft 92.

Mercury drive gear 90 is attached to and may be integrally formed with Mercury drive hub 106, concentric with Venus drive shaft 92. Mercury drive hub 106 rotates counterclockwise one revolution every 88 days. Mercury indicator 86 is attached to Mercury drive hub 106 by wire 108 or another suitable fastener.

Mercury drive gear 90 is attached to and may be integrally formed with No. 2 drive gear 94 which rotates one revolution every 88 days counterclockwise. No. 2 drive gear 94 engages No. 2 transfer gear 96 with a 60:24 ratio, thus rotating gear 96 one revolution every 220 days clockwise. No. 2 transfer gear 96 drives Venus drive gear 98 with the same period and direction of rotation. No. 2 transfer gear 96 and Venus drive gear 98 rotate about stationary shaft 100. Venus drive gear 98 engages return drive gear 102 with a transfer ratio of 1:1 and a period of rotation of one revolution every 220 days counterclockwise. Return drive gear 102 is fixedly attached to Venus drive shaft 92. Venus indicator 84 is attached to Venus drive shaft 92 by a wire 104 or another suitable fastener.

Venus drive shaft 92 and Mercury drive hub 106 penetrate aperture 109 in hour indicator 28 through top mounting plate 84 so that sun indicator 88, Venus indicator 84, and Mercury indicator 86 are exposed to view while planet gear train 82 is obscured from view by opaque hour indicator 28. Planet indicators 84, 86 may be small brass spheres of representational size. Sun indictor 88 may be a brass disk of representative size. Sun indicator 88 is attached to Venus drive shaft 92 by glue or other suitable means and therefore rotates about its center with the same period as Venus indicator 84. Periodic rotation of the sun inicator 88, however, is nearly unnoticeable because sun indicator 88 is symmetric and rotates about its center relative to planet indicators 84, 86.

As hour indicator 28 rotates one revolution per day clockwise, planetary gear train 82 and its planet indicators 84, 86 and sun indicator 88 are carried about earth indicator 110 at the same rate. Thus, sun indicator 88 indicates the relative position of the sun with respect to the earth, while Venus indicator 84 and Mercury indicator 86 represent the positions of these two planets relative to the earth, and also relative to the sun indicator 88 about which they rotate with their natural period of revolution.

Planet gear train 82 may include planet gear train ratchet brake 81 attached to riveted standoff 85 secured to the underside of hour indicator disk 28. Brake 81 yieldingly engages input drive gear 80 for preventing retrograde rotation of gears in planet gear train 82.

A counterweight 112, which may be made of lead, brass, etc., is fixedly attached to the underside of hour indicator disk 28. Counterweight 112 is attached to hour indicator 28 along a diameter defined by a line through the center of hour indicator 28 and the center of planet gear train 82. The weight and placement of counterweight 112 are selected so as to balance the moment of hour disk 28 about shaft 46 due to the weight of planet gear train 82, cam lever 34, and other elements eccentrically carried by hour disk 28.

The celestial clock 10 also includes a data indicator disk 120 having 365 canted teeth (designated by numeral 124) uniformly disposed about its circumference. Date indicator disk 120 is mounted on stationary shaft 46 through aperture 126 (above the display of planet indicators 84, 86, sun indicator 88, moon indicator 60, and moon phase indicator 74) on an extension 77 of collar 75 under a washer 79. Date indicator disk 120 is transparent except for scales printed thereon around its periphery. Date indicator disk 120 may be made of transparent plastic, glass or other suitable material.

Spacing between date indicator disk 120 and hour indicator disk 28 is maintained by transparent standoffs 128 inserted through apertures 130 in hour indicator disk 28 up to collar 132. Standoffs 128 may be made of glass or plastic and may be secured to hour indicator 28 by a suitable adhesive. Rounded top ends 134 of standoffs 128 contact date indicator disk 120 to maintain a constant distance between date indicator disk 120 and hour indicator disk 128. Rounded bottom ends 136 of standoffs 138 contact base plate 14 of clock case 12 for supporting hour indicator disk 28 at a fixed distace from base plate 14.

Date indicator disk drive spring pawl 138 is fixedly attached to date indicator driving end 42 of cam lever 34 by fasteners (not shown) or by adhesive, and yieldingly engages teeth 124 about the circumference of date indicator disk 120. Drive pawl 138 extends through slot 139 in hour indicator disk 28 to engage teeth 124. Driving spring dog 140 is fixedly attached to hour indicator disk 28 by fasteners such as rivets (not shown) or may be attached to time pointer 130. Driving dog 140 yieldingly engages teeth 124 of date indicator 120. Date indicator disk 120 is indexed by a date pointer 142 fixedly attached to hour indicator disk 28 by fasteners such as rivets 144. Referring to FIG. 2, date pointer 142 and time pointer 130 may be mounted on a single bracket 145 secured to hour indicator disk 144.

Figure 5:
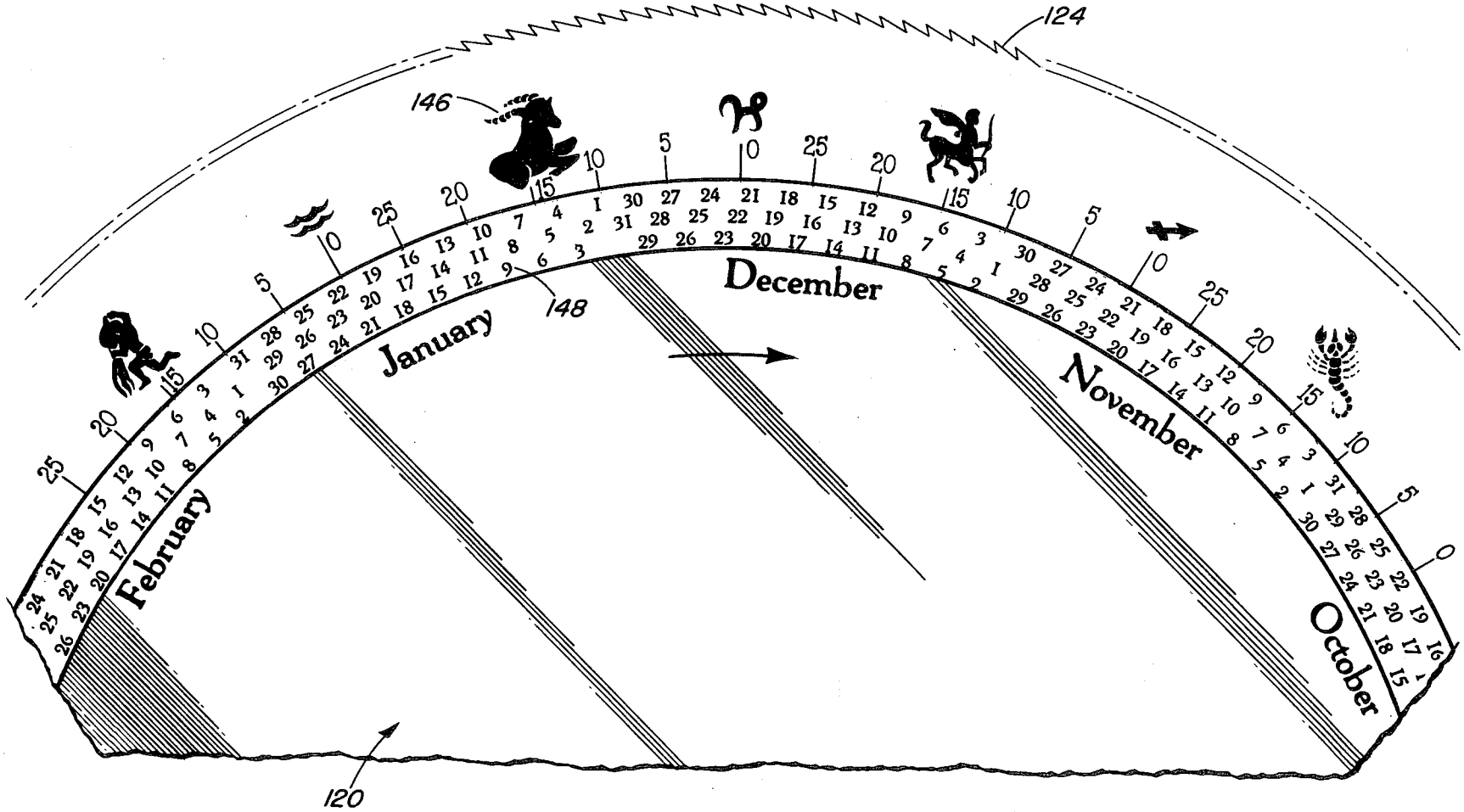
FIG. 5 is an front elevation of a portion of the date disk to illustrate the calendar scale showing the days of the months and the signs and degrees of arc of the signs of the Zodiac.

Referring to FIG. 5, date indicator disk 120 includes a calendar scale 146 which designates the months of the year and the dates of each month. Numerals representing dates of the month are staggered about the circumference of three concentric circles in such a manner that date pointer 142 will clearly point to a single numeral on any given day. Date indicator 120 also includes Zodiac scale 148 which may symbolically illustrate the signs of the Zodiac as illustrated in FIG. 5. Zodiac scale 148 also includes numerals indicating degrees of arc of each sign of the Zodiac.

In operation, as hour indicator disk 28 rotates clockwise one revolution per day, date indicator driving end 42 of cam lever 34 oscillates one cycle per day. During the clockwise portion of the oscillation of date indicator driving end 42, date indicator disk drive pawl 138 engages a tooth 124 of date disk 122, rotating date indicator disk 120 1/365 of a revolution clockwise per day with respect to hour indicator disk 28 about shaft 46. In addition, date indicator disk drive pawl 138 drives date indicator disk 120 at the basic periodic rate of rotation of hour indicator disk 28, i.e., one revolution clockwise per day, because cam lever 34 is attached to hour indicator 28. While date indicator driving end 42 of cam lever 34 is in the counterclockwise portion of its oscillating movement, date indicator disk drive pawl 138 does not drive date indicator disk 120, but moves rearwardly to engage an adjacent tooth 124. During the nondriving portion of the oscillating movement of the date indicator disk drive pawl 138, driving dog 140 engages a tooth 124 of date indicator disk 120 to prevent retrograde rotation of date indicator disk 120 and to impart the basic one revolution per day clockwise rotation of hour indicator disk 28 to date indicator disk 120. Thus, date indicator disk 120 rotates clockwise with a basal period of one revolution per day with respect to its center at shaft 46, and in addition rotates 1/365 revolution per day clockwise with respect to hour indicator disk 28. Because time pointer 30 and date pointer 132 are fixedly attached to hour indicator 28, pointers 30, 132 rotate clockwise one revolution per day. Because data indicator disk 120 advances an additional 1/365 revolution clockwise per day with respect to hour indicator disk 28, a new date on calendar scale 146 and a new position along Zodiac scale 148 will be indicated by date pointer 142 each day.

For aesthetic purposes, hour indicator disk 28 may be opaque to obscure from view the drive mechanisms of celestial clock 10. An opaque daytime/nighttime, sunrise/sunset indicator, not shown, is fixedly attached to the upper surface of hour indicator disk 28. Daytime/-nighttime indicator comprises artwork which may be reproduced by lithography, photography, airbrush or other suitable techniques. The daytime/nighttime indicator features a nighttime sky of deep blue or black including white dots representing stars and may represent constellations. The daytime portion of the display is a clear sky blue color. The daytime and nighttime portions of the display each comprise symmetrically approximately 165 degrees of the total display. Disposed between daytime and nighttime portions of the display are sunrise/sunset portions, respectively, each comprising approximately 15° of the total display. Both the sunrise and sunset portions of the display are reddish pink representations of the appearance of the sky during sunrise and sunset. As hour indicator disk 28 rotates clockwise, date pointer 142 also points to a portion of the daytime/nighttime indicator which aproximately represents the appearance of the sky at any given time of day.

The planets Mars, Jupiter, Saturn, Uranus, Neptune and Pluto of the earth's solar system may be represented by planet indicators, not shown, which are manually movable to represent the positions of the planets with respect to the earth. Manually movable planet indicators may be selectively attached to date indicator disk 120 by a temporary adhesive or other suitable attachment means. While movement of manually movable planet indicators could be automated according to the teachings of the present invention, the relative movement of these planets with respect to the earth is sufficiently slow that periodic manual placement will present a reasonably accurate representation of their position relative to the earth. Mars, for example, the closest of the outer planets to the sun, has a periodic rotation about the sun of 687 earth days, and Pluto, the most distant of the outer planets, has a periodic rotation about the sun of 248 earth years.

The celestial clock 10 may include an oscillating pendulum, not shown, at the bottom of the clock case 12 when the clock is vertically mounted, automatically actuated by a separate electronic or mechanical drive mechanism, or itself providing the regular mechanical movement required to drive the clock. In addition, the celestial clock 10 may be equipped with automatic electronic chimes, actuated by a separate internal clock counter, to strike according to any desired program. A removable glass or other transparent cover may be provided over the face of the clock to keep dust out of the mechanism.

While the preferred embodiments of the invention have been illustrated and described, it is to be understood that these are capable of variation and modification by those skilled in the art and that the scope of the invention is not limited to the precise details set forth, but should be determined by the following claims.

I claim:

1. A clock for indicating daily time and the relative positions of at least two celestial bodies of the earth's solar system with respect to the earth, comprising:

an axis;

a center hub representative of the earth centered on said axis;

hour indicator means rotatable about said axis one revolution per day;

sun indicator means representative of the sun rotatable about said axis one revolution per day, said sun indicator means and said hour indicator means superimposed with respect to each other, and said sun indicator means rotatable relative to said hour indicator means;

planet indicator means representative of a planet rotatable about said sun indicator means at a rate substantially equal to the planet's natural period of revolution about the sun; and drive means for automatically rotating said indicator means at their prescribed rates.

2. A clock for indicating daily time and the relative position of the earth's moon with respect to the earth comprising:

an axis;

a center hub representative of the earth centered on said axis;

hour indicator means rotatable about said axis one revolution per day;

moon indicator means representative of the earth's moon rotatable about said axis at a rate substantially equal to the moon's natural period of revolution about the earth, said moon indicator means and said hour indicator means superimposed with respect to each other, and said sun indicator means rotatable relative to said hour indicator means; and drive means for automatically rotating said indicator means at their prescribed rates.

3. A clock according to claim 1 further comprising moon indicator means representative of the earth's moon rotatable about said axis at a rate substantially equal to the moon's natural period of revolution about the earth.

4. A clock according to claim 1 or 3 wherein said planet indicator means comprises a plurality of planet indicator means representative of different planets rotatable about said sun indicator means at individual rates equal to their respective plant's natural periods of revolution about the sun.

5. A clock according to claim 2 or 3 further comprising a moon phase indicator means including a stationary mask overlying a portion of the path of travel of said moon indicator means for obscuring from view an appropriate portion of said moon indicator means to indicate phases of the moon.

6. A clock in accordance with claim 4 wherein one of said planet indicator means represents the planet Venus and said drive means rotates said Venus indicator means about said sun indicator means substantially one revolution every 220 days; and another planet indicator means represents the planet Mercury and said drive means rotates said Mercury indicator means about said sun indicator means substantially one revolution every 88 days.

7. A clock for indicating daily time and the relative positions of at least two celestial bodies of the earth's solar system with respect to the earth, comprising:

an axis;

a center hub representative of the earth centered on said axis;

hour indicator means rotatable about said axis one revolution per day;

sun indicator means representative of the sun rotatable about said axis one revolution per day;

planet indicator means representative of a planet rotatable about said sun indicator means at a rate substantially equal to the planet's natural period of revolution about the sun; and drive means for automatically rotating said indicator means at their prescribed rates, said drive means comprising a motor having a rotating output drive gear;

an hour indicator gear in engagement with said drive gear and attached to said hour indicator means for rotating said hour indicator means about said axis;

a stationary cam positioned at said axis having a cam profile extending around said axis;

a cam lever pivotally attached to said hour indicator means at a point remote from said cam, and having a cam engaging end in driving engagement with said cam profile so that said lever undergoes oscillating movement about said pivot point in response to rotation of said hour indicator means about said axis;

a planet indicator gear train rotatable with said sun indicator means about said center hub, and including an input gear and a planet output gear connected to said planet indicator means; and a planet indicator drive pawl attached to said cam lever and in ratcheting driving engagement with said planet indicator input gear for incrementally rotating said planet indicator means in response to oscillating movement of said lever.

8. A clock according to claim 3 wherein said drive means further comprises:

a motor having a rotating output drive gear;

an hour indicator gear in engagement with said drive gear and attached to said hour indicator means for rotating said hour indicator means about said axis;

a stationary cam positioned at said axis having a cam profile extending around said axis;

a cam lever pivotally attached to said hour indicator means at a point remote from said cam, and having a cam engaging end in driving engagement with said cam profile so that said lever undergoes oscillating movement about said pivot point in response to rotation of said hour indicator means about said axis;

a moon gear connected to said moon indicator means and mounted for rotation about said axis; and a moon indicator drive pawl attached to said cam lever and in ratcheting driving engagement with said moon gear for incrementally rotating said moon indicator means in response to oscillating movement of said lever.

9. A clock according to claim 8 wherein said drive means further includes means for biasing said cam lever against said cam for insuring that said cam lever follows said cam profile.

10. A clock according to claim 8 wherein said drive means further includes a moon gear ratchet brake attached to said hour indicator means in ratcheting engagement with said moon gear for preventing retrograde rotation of said moon gear.

11. A clock according to claim 7 wherein said planet indicator means comprises a plurality of planet indicator means representative of different planets, said gear train has a plurality of planet output gears, and each of said planet indicator means is attached to a separate planet output gear for rotation about said sun indicator means at individual rates equal to their respective planet's natural periods of revolution about the sun.

12. A clock according to claim 1 or 11 wherein said drive means further includes means for biasing said cam lever against said cam for insuring that said cam lever follows said cam profile.

13. A clock for indicating daily time and the date of the year comprising:

an axis;

hour indicator means including an hour disk rotatable about said axis one revolution per day;

date indicator means including a date disk superposed with said hour disk and rotatable with said hour disk about said axis one revolution per day, and additionally rotatable with respect to said hour disk one revolution every 365 days; and a drive means for automatically rotating said disks at their prescribed rates.

14. A clock in accordance with claim 13 wherein said hour indicator means includes an hour pointer affixed to and rotatable with said hour disk, and a continuous stationary time scale adjacent the perimeter of said hour disk to which said hour pointer points, and said date indicator means includes a continuous calendar scale on said date disk, and a date pointer affixed to said hour disk which points to said calendar scale.

15. A clock according to claim 13 wherein said drive means further comprises:

a motor having a rotating output drive gear;

hour disk gear teeth about the circumference of said hour disk in driving engagement with said drive gear;

a stationary cam positioned at said axis having a cam profile extending around said axis;

a cam lever pivotally attached to said hour disk at a point remote from said cam, and having a cam engaging end in driving engagement with said cam profile so that said lever undergoes oscillating movement about said pivot point in response to rotation of said hour disk about said axis, and a date disk driving end for driving said date disk;

365 date disk gear teeth about the circumference of said date disk;

date disk drive pawl attached to said driving end of said cam lever and in ratcheting driving engagement with said date disk gear teeth for incrementally rotating said date disk with respect to said hour disk one revolution every 365 days in response to oscillating movement of said lever; and date disk driving dog attached to said hour disk in ratcheting engagement with said date disk gear teeth for insuring that said date disk rotates synchronously with said hour disk.

16. A clock according to claim 13 or 14 wherein said date disk includes the signs of the Zodiac and the degrees of arc of each sign of the Zodiac in proper relation to said calendar scale, whereby said date indicator means also indicates the sign of the Zodiac in which the earth is located and the degrees of arc of the position of earth within said sign of the Zodiac.

17. A clock for indicating daily time, the date of the year, the relative positions of at least two celestial bodies of the earth's solar system and the earth's moon with respect to the earth, and the phases of the moon with respect to the earth comprising:

an axis;

a center hub representative of the earth centered on said axis;

hour indicator means including an hour disk rotatable about said axis one revolution per day;

date indicator means including a date disk superposed with said hour disk and rotatable with said hour disk about said axis one revolution per day, and additionally rotatable with respect to said hour disk one revolution every 365 days;

sun indicator means representative of the sun carried by said hour disk and rotatable about said axis one revolution per day;

planet indicator means representative of a planet rotatable about said sun indicator means at a rate substantially equal to the planet's natural period of revolution about the sun;

moon indicator means representative of the earth's moon rotatable about said axis at a rate substantially equal to the moon's natural period of revolution about the earth;

moon phase indicator means including a stationary mask overlying a portion of the path of travel of said moon indicator means for obscuring from view an appropriate portion of said moon indicator means to indicate phases of the moon; and drive means for automatically rotating said indicator means at their prescribed rates.

18. A clock according to claim 17 wherein said hour indicator means includes an hour pointer affixed to and rotatable with said hour disk, and a continuous stationary time scale adjacent the perimeter of said hour disk to which said hour pointer points, and said date indicator means includes a continuous calendar scale on said date disk, and a date pointer affixed to said hour disk which points to said calendar scale.

19. A clock according to claim 18 wherein said drive means further comprises:

a motor having a rotating output drive gear;

hour disk gear teeth about the circumference of said hour disk in driving engagement with said drive gear;

a stationary cam positioned at said axis having a cam profile extending around said axis;

a cam lever pivotally attached to said hour disk at a point between its two ends remote from said cam, and having a cam engaging end in driving engagement with said cam profile so that said lever undergoes oscillating movement about said pivot point in response to rotation of said hour disk about said axis, and a date disk driving end for driving said date disk;

a planet indicator gear train affixed to said hour disk beneath said sun indicator means including an input gear and a planet output gear;

a planet indicator drive pawl attached to said cam lever and in ratcheting driving engagement with said planet indicator input gear for incrementally rotating said planet indicator means in response to oscillating movement of said lever;

a moon gear connected said moon indicator means and mounted for rotation about a said axis;

a moon indicator drive pawl attached to said cam lever and in ratcheting driving engagement with said moon gear for incrementally rotating said moon indicator means in response to oscillating movement of said lever;

365 date disk gear teeth about the circumference of said date disk; a date disk drive pawl attached to said driving end of said cam lever and in racheting driving engagement with said date disk gear teeth for incrementally rotating said date disk with respect to said hour disk one revolution every 365 days in response to oscillating movement of said lever; and a date disk brake pawl attached to said hour disk in ratcheting engagement with said date disk gear teeth for insuring that said date disk rotates synchronously with said hour disk.

20. A clock according to claim 19 wherein said drive means further includes means for biasing said cam lever against said cam for insuring that said cam lever follows said cam profile.

21. A clock according to claim 20 wherein said drive means further includes a moon gear ratchet brake attached to said hour disk in ratcheting engagement with said moon gear for preventing retrograde rotation of said moon gear.

22. A clock according to claim 21 wherein said planet indicator means comprises a plurality of planet indicator means representative of different planets rotatable about said sun indicator means at individual rates equal to their respective planets' natural periods of revolution about the sun.

23. A clock according to claim 22 wherein one of said planet indicator means represents the planet Venus and said drive means rotates said Venus indicator means about said sun indicator means substantially one revolution every 220 days; and another planet indicator means represents the planet Mercury and said drive means rotates said Mercury indicator means about said sun indicator means substantially one revolution every 88 days.

24. A clock according to claim 23 including third through eighth planet indicator means carried by said date disk representing the planets Mars, Jupiter, Saturn, Uranus, Neptune and Pluto of the earth's solar system, wherein said third through eighth planet indicators are individually manually movable to represent the respective positions of these planets with respect to said earth.

25. A clock according to claim 24 wherein said date disk includes the signs of the Zodiac and the degrees of arc of each sign of the Zodiac in proper relation to said calendar scale, whereby said date indicator means also indicates the sign of the Zodiac in which the earth is located and the degrees of arc of the position of the earth within said sign of the Zodiac.

26. A clock according to claim 25 wherein said hour indicator means includes daytime/nighttime indicator means for indicating approximately the hours of daylight and darkness and the approximate time of sunrise and sunset, rotatable with said hour indicator means about said axis.

27. A clock for indicating daily time and relative position of the earth's moon with respect to the earth comprising:

an axis;

a center hub representative of the earth centered on said axis;

hour indicator means rotatable about said axis one revolution per day;

moon indicator means representative of the earth's moon rotatable about said axis at a rate substantially equal to the moon's natural period of revolution about the earth; and drive means for automatically rotating said indicator means at their prescribed rates, said drive means comprising a motor having a rotating output drive gear;

an hour indicator gear in engagement with said drive gear and attached to said hour indicator means for rotating said hour indicator means about said axis;

a stationary cam positioned at said axis having a cam profile extending around said axis;

a cam lever pivotally attached to said hour indicator means at a point remote from said cam, and having a cam engaging end in driving engagement with said cam profile so that said lever undergoes oscillating movement about said pivot point in response to rotation of said hour indicator means about said axis;

a moon gear connected to said moon indicator means and mounted for rotation about said axis; and a moon indicator drive pawl attached to said cam lever and in ratcheting driving engagement with said moon gear for incrementally rotating said moon indicator means in response to oscillating movement of said lever.

* * * * *